US011523643B2

(12) United States Patent
Shoemaker

(10) Patent No.: US 11,523,643 B2
(45) **Date of Patent: *Dec. 13, 2022**

(54) WOMEN'S EASY-ON ONE-PIECE BATHING SUIT

(71) Applicant: Susanne Leary Shoemaker, New Rochelle, NY (US)

(72) Inventor: Susanne Leary Shoemaker, New Rochelle, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/925,491

(22) Filed: Jul. 10, 2020

(65) Prior Publication Data

US 2020/0337394 A1 Oct. 29, 2020

Related U.S. Application Data

(60) Division of application No. 15/239,276, filed on Aug. 17, 2016, now Pat. No. 10,709,177, which is a (Continued)

(51) Int. Cl.
*A41D 7/00* (2006.01)
*A41D 1/14* (2006.01)
(Continued)

(52) U.S. Cl.
CPC ..... *A41D 7/00* (2013.01); *A41B 9/001* (2013.01); *A41B 9/008* (2013.01); *A41B 9/02* (2013.01);
(Continued)

(58) Field of Classification Search
CPC . A41D 7/00; A41D 1/14; A41D 7/001; A41D 7/003; A41D 7/005; A41D 7/006;
(Continued)

(56) References Cited

U.S. PATENT DOCUMENTS 342,494 A 5/1886 Baldwin
436,607 A 9/1890 Litle
(Continued)

FOREIGN PATENT DOCUMENTS

DE 3839010 A1 5/1990
DE 202004011134 U1 11/2004
(Continued)

*Primary Examiner* — Jameson D Collier
(74) *Attorney, Agent, or Firm* — Banner & Witcoff, Ltd.

(57) ABSTRACT

A womens one-piece bathing suit garment includes a bodice panel and an underwear portion. The bodice panel has a vertically placed connection mechanism which forms the torso of the garment. The underwear portion includes a plurality of waistband panels, a front panel, and a primary panel. The front of the bodice panel extends below waist-level to form the plurality of waistband panels. The primary panel forms the rear of the underwear portion of the garment. The primary panel is connected to the plurality of waistband panels via continuous pieces of material forming the leg openings of the garment. The primary panel is connected to the front panel to form a crotch of the garment. The front panel connects to the plurality of waistband panels via a connection mechanism, which upon connecting, the front panel forms the front for the underwear portion of the bathing suit garment.

18 Claims, 11 Drawing Sheets

Related U.S. Application Data continuation of application No. 13/837,529, filed on Mar. 15, 2013, now abandoned, which is a continuation of application No. 29/444,838, filed on Feb. 4, 2013, now abandoned, which is a continuation of application No. 29/413,035, filed on Feb. 9, 2012, now Pat. No. Des. 677,447.

(51) Int. Cl.
*A41B 9/00* (2006.01)
*A41B 9/04* (2006.01)
*A41B 9/02* (2006.01)

(52) U.S. Cl.
CPC ..... *A41B 9/04* (2013.01); *A41D 1/14* (2013.01); *A41D 2300/22* (2013.01); *A41D 2300/32* (2013.01); *A41D 2300/322* (2013.01); *A41D 2300/324* (2013.01); *A41D 2300/326* (2013.01); *A41D 2300/33* (2013.01)

(58) Field of Classification Search
CPC ..... A41D 1/22; A41D 15/00; A41D 15/002; A41D 2300/22; A41D 2300/32; A41D 2300/322; A41D 2300/324; A41D 2300/326; A41D 2300/33; A41B 9/001; A41B 9/008; A41B 9/02; A41B 9/04; A41B 9/08; A41B 9/16
USPC ..... 2/67, 70–72, 74, 76, 406, 407
See application file for complete search history.

(56) References Cited

U.S. PATENT DOCUMENTS 1,096,477 A 5/1914 Weisert
1,195,904 A 8/1916 Bornstein
1,201,307 A 10/1916 Joseph
1,619,176 A 3/1927 Atwell
1,973,963 A 9/1934 Nishimoto
1,995,531 A 3/1935 Bachelis
2,012,879 A 8/1935 Kneibler
2,427,906 A 9/1947 Golightly et al.
2,431,571 A 11/1947 Irving
2,443,474 A 6/1948 Morgan
2,453,051 A 11/1948 Vacca
2,483,076 A 9/1949 Umberto
2,529,277 A 11/1950 Borowick
2,531,900 A 11/1950 Andrews
2,561,783 A 7/1951 Burr
2,575,054 A 11/1951 Gowdy
2,591,423 A 4/1952 Grolitzer
2,638,900 A 5/1953 Gruenberg
2,661,002 A 12/1953 Silverman
2,739,595 A 3/1956 Huggins
2,824,560 A 2/1958 Clinton
2,838,761 A 6/1958 Title
2,857,600 A * 10/1958 Finn ..... A41D 7/00 2/67
3,036,574 A 5/1962 Jeffrey
3,068,488 A 12/1962 Rodriguez
3,144,668 A 8/1964 Palesotti
3,280,819 A 10/1966 Weeks
3,397,696 A 8/1968 Rickard
3,487,833 A 1/1970 Senser
3,733,859 A 5/1973 Wittmann
3,771,172 A 11/1973 Barg
3,806,953 A 4/1974 Kalil
4,031,568 A 6/1977 Huff
4,051,854 A 10/1977 Aaron
4,145,763 A 3/1979 Abrams et al.
4,338,371 A 7/1982 Dawn et al.
4,355,425 A 10/1982 Jones et al.
4,538,614 A 9/1985 Henderson
4,573,987 A 3/1986 Lamb, Jr.
4,675,918 A 6/1987 O'Brien
4,928,323 A 5/1990 Nathan
5,031,248 A 7/1991 Kemper
5,100,399 A 3/1992 Janson et al.
D330,590 S 10/1992 Pressley et al.
5,184,968 A 2/1993 Michalochick et al.
5,325,543 A 7/1994 Allen
5,535,452 A 7/1996 Rozenblat
5,561,858 A 10/1996 Poirier
5,717,998 A 2/1998 Everett et al.
5,926,853 A 7/1999 Plank
5,944,708 A 8/1999 Philpott
5,991,920 A 11/1999 Holland
6,035,439 A 3/2000 Chin
6,237,152 B1 5/2001 Gootrad
6,240,560 B1 6/2001 DeCaro
6,247,184 B1 6/2001 Watts
6,338,161 B1 1/2002 Ali Muhammad
D456,108 S 4/2002 Frederick
6,374,412 B1 4/2002 Canlas
6,412,119 B1 7/2002 Robles
6,560,786 B2 5/2003 Lipton
6,817,038 B2 11/2004 Blanco
7,260,852 B2 * 8/2007 Sheetz ..... A41D 7/00 2/67
7,553,303 B2 6/2009 Speak
7,722,593 B2 5/2010 Lee
7,823,223 B2 11/2010 Ehmsen
8,117,675 B2 2/2012 Strange et al.
D712,625 S 9/2014 Vasquez
8,870,624 B2 10/2014 Hopkins
9,560,889 B1 2/2017 White
10,709,177 B2 * 7/2020 Shoemaker ..... A41B 9/008
D905,933 S * 12/2020 Abramowitz ..... A41D 7/00 D2/745
D927,133 S * 8/2021 Abramowitz ..... A41B 9/008 D2/745
2004/0000005 A1 1/2004 Holland
2004/0034902 A1 2/2004 Yturria
2006/0026734 A1 2/2006 Fitzgerald
2006/0272069 A1 12/2006 Sheetz
2006/0277663 A1 12/2006 King
2007/0006360 A1 1/2007 Walker
2007/0157367 A1 7/2007 Kerkhoff
2008/0222781 A1 9/2008 Rhew
2009/0118574 A1 5/2009 Stephenson
2010/0005561 A1 1/2010 Holland et al.
2010/0005570 A1 1/2010 Rachman
2010/0191208 A1 7/2010 Kane
2011/0016604 A1 1/2011 Lim
2013/0180024 A1 7/2013 Flick
2014/0101814 A1 4/2014 Caulfield et al.
2015/0044943 A1 2/2015 Marshall et al.
2015/0173427 A1 6/2015 Sawyer
2016/0037837 A1 2/2016 Ferrara
2016/0143373 A1 5/2016 Castellano et al.
2017/0164667 A1 6/2017 Street
2018/0084842 A1 3/2018 Pham Johnson et al.

FOREIGN PATENT DOCUMENTS

DE 102005044687 A1 3/2007
FR 1386435 A 1/1965
GB 191228746 A 4/1913
WO 2005097032 A1 10/2005

* cited by examiner

WOMEN'S EASY-ON ONE-PIECE BATHING SUIT

CROSS-REFERENCE TO RELATED APPLICATIONS

This application is a divisional of U.S. patent application Ser. No. 15/239,276, filed Aug. 17, 2016, and entitled "Women's Easy-On One-Piece Bathing Suit," which is a continuation of Utility patent application Ser. No. 13/837,529, filed Mar. 15, 2013, entitled "Easy-On Underwear Garment", which is a continuation of 29/444,838, filed Feb. 4, 2013, which is a continuation of 29/413,035, filed Feb. 9, 2012, entitled "Panty Garment", and which issued on Mar. 12, 2013 as Patent No. D677,447, the disclosures of which are incorporated herein by reference in their entirety.

BACKGROUND

Many women are unable to wear traditional one-piece bathing suits and generally find it difficult to balance on one leg or even to sit down and bend at the knee or hip to pull on their bathing suit. Others may find it difficult to fit a leg through the hole of a traditional one-piece bathing suit garment, for example, because of a cast or other medical impediment. Still others who require assistance to get dressed, and caregivers who assist incapacitated individuals, find it difficult to use traditional one-piece women's bathing suits that must be maneuvered over the feet, up the legs, over the hips, up the torso, and over the shoulders. Therefore, women who are temporarily or chronically disabled, or who otherwise find it difficult to put on a traditional bathing suit garment unassisted, or find it difficult and embarrassing to be assisted with a traditional bathing suit garment, will appreciate a one-piece bathing suit that is easy to put on without assistance or with minimal assistance, that is sleek and tasteful and does not look like a medical garment, and enables the wearer to maintain individual independence and dignity.

BRIEF DESCRIPTION OF THE DRAWINGS

The foregoing and other aspects of various embodiments of the present invention will be apparent through examination of the following detailed description thereof in conjunction with the accompanying drawing figures in which similar reference numbers are used to indicate functionally similar elements.

DETAILED DESCRIPTION

Figure 1:
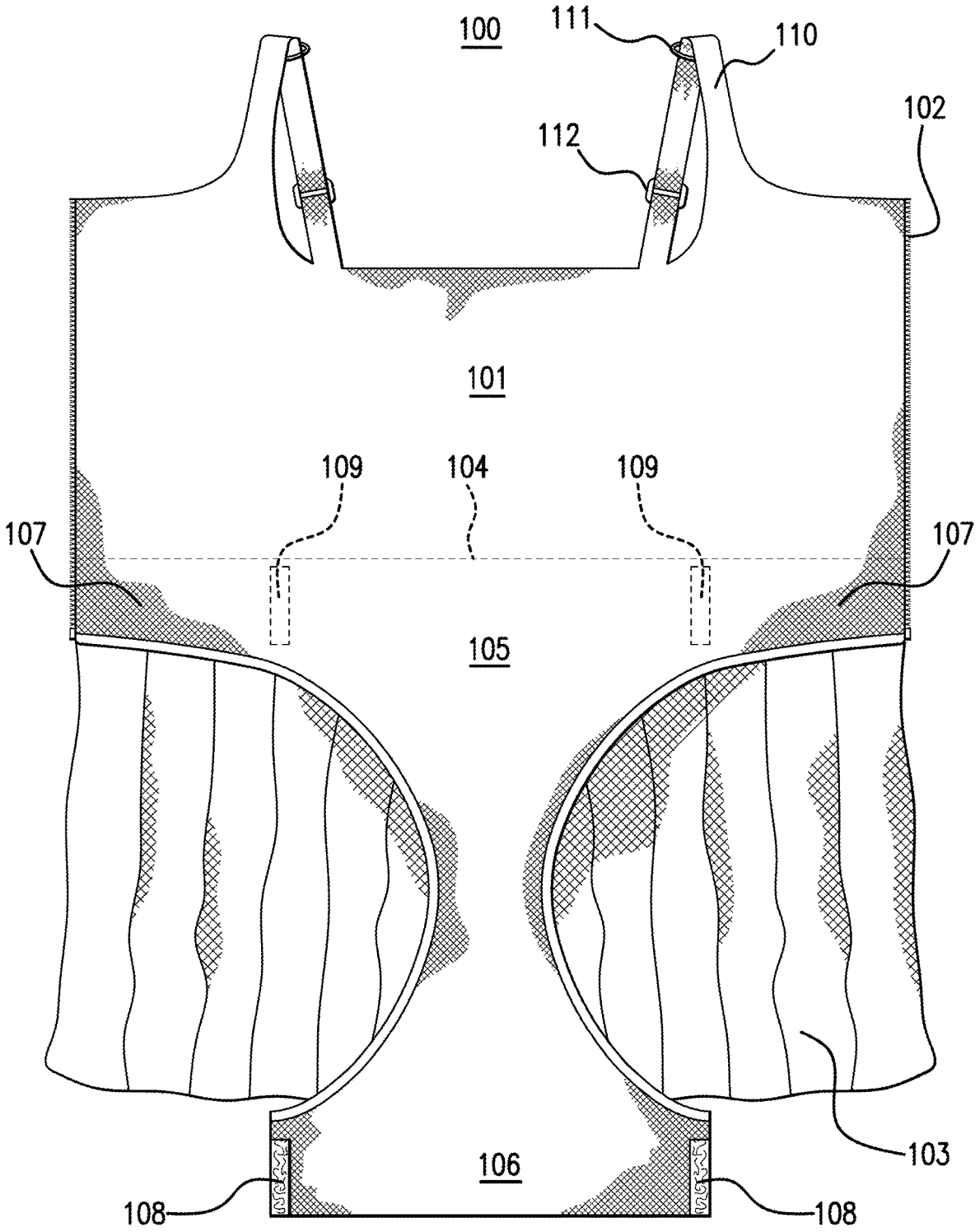
FIG. 1 illustrates a completely open view of an inside of an example women's one-piece bathing suit garment according to an embodiment of the present invention.

A women's one-piece bathing suit garment comprising a vest-like bodice panel and an underwear portion is described. The vest-like bodice panel and the underwear portion are formed to allow a woman to put on the bathing suit without having to balance, bend, stretch, or otherwise maneuver the garment over the feet, up the legs, over the hips, up the torso, and over the shoulders. The garment is designed in one piece with two closures, including a connection mechanism located on the bodice panel to close the bodice and a pull-through panel located on the underwear portion of the garment to close the underwear, therefore forming a one-piece garment to replace traditional women's one-piece bathing suit garments that are difficult to put on.

The women's one-piece bathing suit garment is formed from a vest-like bodice panel that forms a torso portion for the garment, wherein the left and right sides of the bodice panel connect to each other via a connection mechanism placed vertically down the front center of the bodice panel. The underwear portion includes a plurality of waistband panels, a primary panel and a front panel. The front portion of the bodice panel extends below waist-level to form the plurality of waistband panels in the front of the garment. The garment is designed such that the connector placed vertically down the front center of the bodice panel ends at the bottom of the plurality of waistband panels. A skirt panel is attached to the bodice panel at hip-level, above the plurality of waistband panels. The skirt panel is designed to attach to the bodice panel at the left and right sides of the bodice panel connection mechanism and extend around the back portion of the bodice panel, creating a horizontal attachment between the skirt panel and the bodice panel. The skirt panel is further designed such that it does not extend over the connection mechanism of the bodice panel, thereby leaving the front center of the underwear portion of the garment exposed.

The primary panel of the underwear portion is attached to the back of the bodice panel, which forms the rear of the underwear portion of the bathing suit. The primary panel connects to the plurality of waistband panels on the left and right sides via continuous pieces of material to form the leg openings. The primary panel also connects to the front panel of the underwear portion via a continuous piece of material to form a crotch of the garment. The front panel further connects to the plurality of waistband panels via a connection mechanism, including a plurality of connection elements placed on each of the front panel and the plurality of waistband panels. Upon connecting the front panel to the plurality of waistband panels, the front panel forms the front for the underwear portion of the one-piece bathing suit and a portion of the front panel and a portion of the plurality of waistband panels overlap. Upon connecting the front panel to the plurality of waistband panels, the women's one-piece bathing suit garment is designed such that the skirt panel completely covers the connection elements placed on each of the front panel and the plurality of waistband panels, and completely covers the primary panel.

Embodiments of the women's one-piece bathing suit garment are designed to resemble any traditional design of a one-piece bathing suit garment, for example, a women's swimsuit or a women's tank suit. Embodiments of the bathing suit garment are designed to provide additional protection for incontinence, including by providing space for extra padding, for disposable padding, or for absorbing netting. Embodiments of the women's one-piece bathing suit garment are designed to provide a compression bathing suit garment that is easy to put on by using elastic materials. As traditional compression bathing suit garments must be pulled over the feet, up the legs, over the hips, up the torso, and over the shoulders, the elasticity of the fabric makes pulling on the traditional garment extremely difficult. Therefore, a garment that is easy to put on as described herein while maintaining the compression effect will be appreciated. Such an embodiment can be used by individuals who are unable to maneuver on a traditional compression garment. Embodiments of the women's one-piece bathing suit garment are designed to be adjustable by providing multiple connection mechanisms spaced to provide for different sizes.

FIG. 1 illustrates a completely open view of an inside of an example womens one-piece bathing suit garment 100 according to an embodiment of the present invention. The one-piece bathing suit garment 100 has a vest-like bodice panel 101, which forms the torso portion of the garment 100, wherein the left and right sides of the vest-like bodice panel 101 are connected via a connection mechanism 102 that is placed vertically down the front center of the vest-like bodice panel 101. As shown, the connection mechanism 102 can consist of a zipper. Other connection mechanisms such as VELCRO® (a type of hook-and-loop fastener), one or more snaps, one or more clasps, one or more eyehooks, a swan hook, a 5-hook, a buckle, or a combination thereof can be used to connect the left and right sides of the bodice 101.

As shown, the one-piece bathing suit garment 100 has a skirt panel 103, which attaches horizontally to the vest-like bodice panel 101 via a connection mechanism 104 located below waist-level. The connection mechanism 104 can be a permanent connection mechanism such as a seam, or a detachable connection mechanism such as a hook-and-loop fastener, one or more snaps, one or more clasps, one or more eyehooks, a swan hook, a 5-hook, a buckle, or a combination thereof. The connection mechanism 104 attaches the skirt panel 103 to the outside of the bodice panel 101 next to the connection mechanism 102 and extends around the back portion of the bodice panel 101, creating a horizontal attachment between the skirt panel 103 and the bodice panel 101. By attaching the skirt panel 103 next to the connection mechanism 102, the skirt panel 103 does not extend over the connection mechanism 102, nor does the skirt panel 103 cover the connection mechanism 102. Yet in another embodiment which is not shown in the figures, the skirt panel 103 can be connected detachably (or partially detachably) to the bodice panel 101 and can extend over the connection mechanism 102, thereby covering the connection mechanism 102.

As shown in FIG. 1, the vest-like bodice panel 101 extends below the connection mechanism 104 to the underwear portion of the one-piece bathing suit garment 100. The underwear portion includes two waistband panels 107, a primary panel 105, and a front panel 106. The waistband panels 107 are positioned below the connection mechanism 104. The waistband panels 107 include the lower portion of the connection mechanism 102, such that the connection mechanism 102 ends at the bottom of waistband panels 107. The vest-like bodice panel 101 includes a primary panel 105, which is continuous with the back of the vest-like bodice panel 101 and forms the rear of the underwear portion of the one-piece bathing suit garment 100. The primary panel 105 connects to the waistband panels 107 on the left and right sides via continuous pieces of material to form the leg openings. As shown, the primary panel 105 connects to the front panel 106 via a continuous, central portion of material that goes between the legs of the user forming a crotch for the garment 100. The vest-like bodice panel 101, the waistband panels 107, the primary panel 105, and the front panel 106 are all part of a single garment, even when fully opened and all connection mechanisms are disengaged.

As shown in FIG. 1, the front panel 106 includes a pair of connectors 108. According to an embodiment, the connectors 108 are placed on the inside of the front panel 106 (i.e., inside of the bathing suit). The connectors 108 can consist of hook-and-loop fastener attached to the inside of front panel 106. Similarly, each waistband panel 107 includes a connector 109. According to an embodiment, each connector 109 is placed on the outside of each waistband panel 107 (i.e., outside of the bathing suit). The connector 109 can consist of hook-and-loop fastener attached to the outside of each waistband panel 107. Each connector 108 of the front panel 106 can attach to the respective connector 109 of the respective waistband panel 107. When closed, the front panel 106 attaches to the outside of the waistband panels 107 to form the front of the underwear portion of the one-piece bathing suit garment 100.

As shown in FIG. 1, the vest-like bodice panel 101 includes shoulder straps 110, which are adjustable. The shoulder straps 110 each include connection mechanisms 111 and 112. The connection mechanisms 111 and 112 can each be configured as adjustable fasteners and can be used to adjust the length of the shoulder straps 110.

Figure 2:
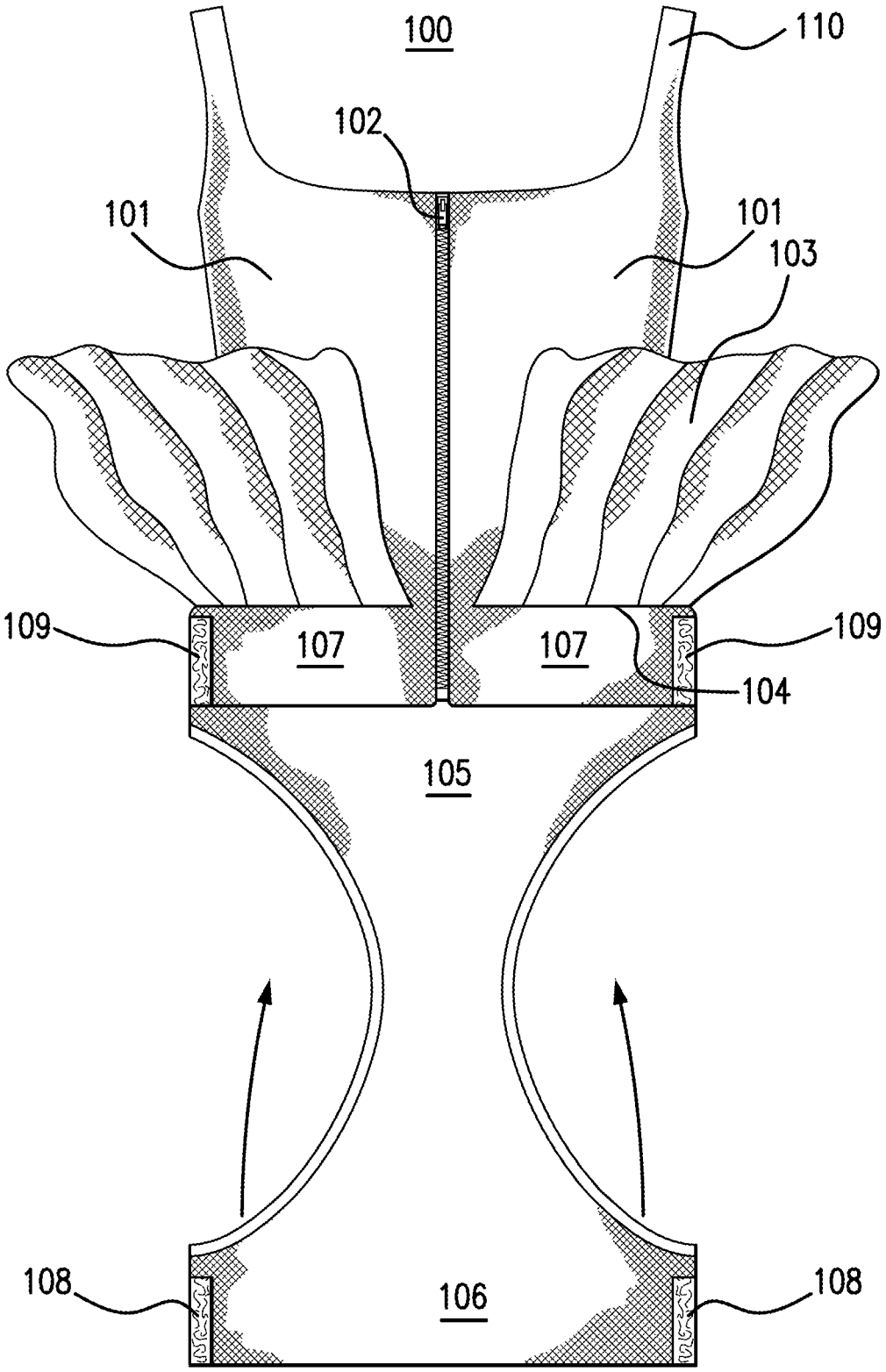
FIG. 2 illustrates a front view of an example women's one-piece bathing suit garment according to an embodiment of the present invention wherein the front panel is disengaged.

FIG. 2 illustrates a front view of an example women's one-piece bathing suit garment 100 according to an embodiment of the present invention. As shown in FIG. 2, the skirt panel 103 is raised to expose the waistband panels 107 and the underwear portion of the bathing suit garment 100. The front panel 106 is completely disengaged. The vest-like bodice panel 101 includes the connection mechanism 102, which is completely closed. When closed, the connection mechanism 102 connects the left and right sides of the bodice panel 101. By closing the connection mechanism 102, the vest-like bodice panel 101 can be wrapped around the torso of the wearer to connect the left and right sides of the bodice panel 101 in the front of the body.

As shown in in FIG. 2, the skirt panel 103 is horizontally attached to the bodice panel 101 via the connection mechanism 104 at both sides of the connection mechanism 102. In this embodiment, the skirt panel 103 does not overlap the connection mechanism 102.

As shown in FIG. 2, the underwear portion of the one-piece bathing suit garment 100 includes the waistband panels 107, a primary panel 105 and a front panel 106. The front panel 106 connects to the primary panel 105 via a central portion that goes between the legs of the wearer forming the crotch for the bathing suit garment 100. The central portion can include additional padding for comfort, can include a removable insert or netting for additional absorbency, or can otherwise function as the underwear portion of a traditional bathing suit garment.

As shown in FIG. 2, the front panel 106 includes a pair of connectors 108 attached to the inside of the front panel 106. An example connector 108 in the form of a piece of hook-and-loop fastener is illustrated in FIG. 2. As shown, each waistband panel 107 includes a connector 109 attached to the inside of each waistband panel 107. Example connectors 108 in the form of pieces of hook-and-loop fastener are illustrated in FIG. 2. The front panel 106 can be connected to the waistband panels 107 via connectors 108 and 109 that can consist of hook-and-loop fastener, one or more snaps, one or more clasps, one or more eyehooks, a swan hook, an 5-hook, a buckle, hooks, or other mechanisms for connecting the front panel 106 to the waistband panel 107.

According to an embodiment, when closed, the front panel 106 attaches to the waistband panels 107 and completely overlaps the waistband panels 107.

By connecting the bodice panel 101 around the torso via connection mechanism 102, and then by reaching between the legs of the user to pull the front panel 106 to the front of the body and connect the front panel 106 to the waistband panels 107 via connectors 108 and 109, respectively, the one-piece bathing suit garment 100 can be wrapped around the body and closed in the front without requiring the wearer to balance on one leg, bend at the knee or waist, or otherwise maneuver the garment 100 over the feet, up the legs, over the hips, up the torso, and over the shoulders. Such a garment can be preferable for individuals who may be bedridden, wheelchair bound, temporarily or chronically disabled, or who otherwise find it difficult or embarrassing to put on a traditional one-piece bathing suit garment unassisted or with minimal assistance.

Figure 3:
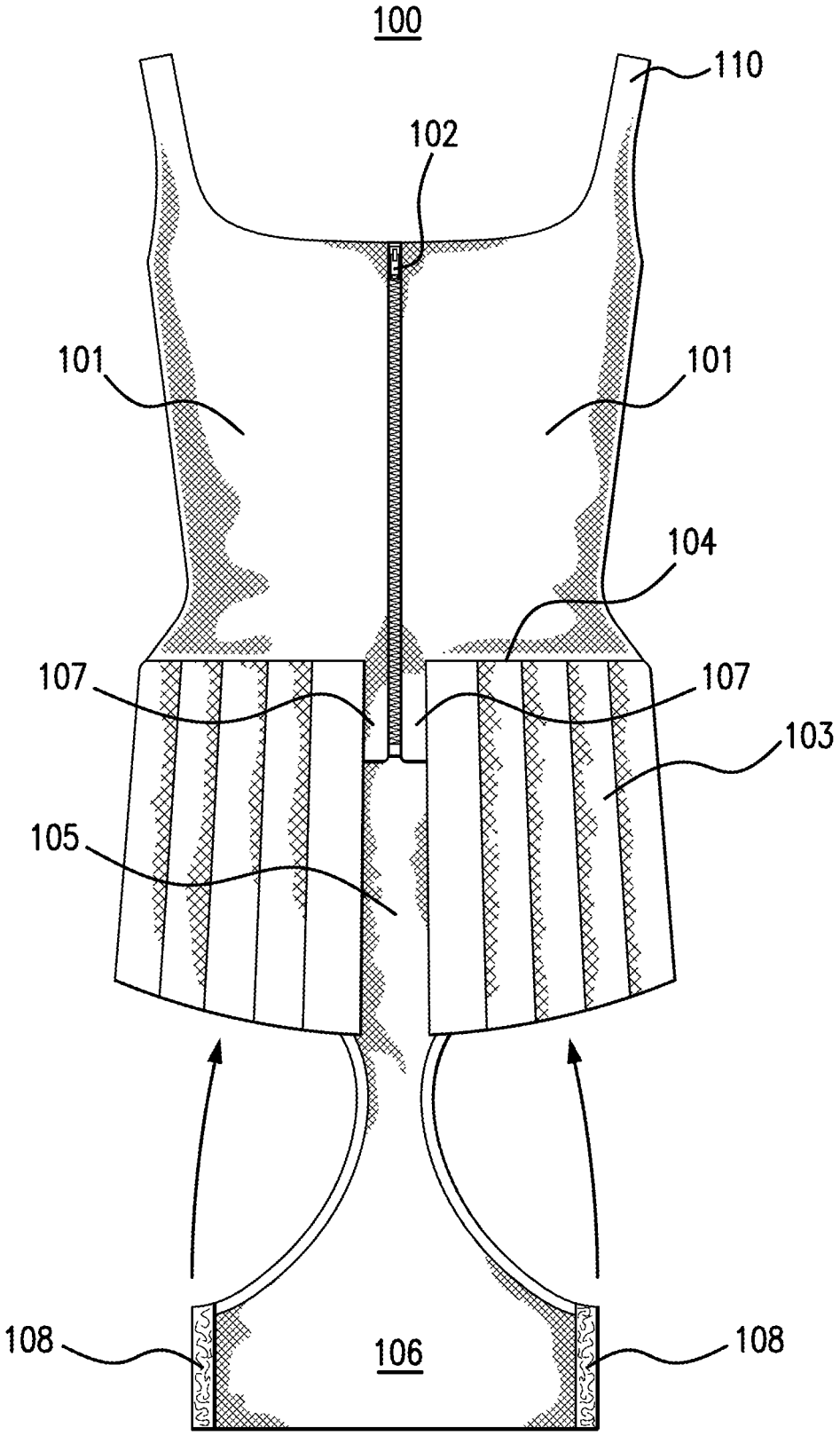
FIG. 3 illustrates a front view of an example women's one-piece bathing suit garment according to an embodiment of the present invention wherein the front panel is disengaged.

FIG. 3 illustrates a front view of an example women's one-piece bathing suit garment 100 according to an embodiment of the present invention. As shown in FIG. 3, the front panel 106 is completely disengaged. The skirt panel 103 is down. As previously noted, the skirt panel is connected to the vest-like bodice panel 101 via the connection mechanism 104. In this embodiment, the skirt panel 103 does not overlap the connection mechanism 102, and the connection mechanism 104 does not overlap the connection mechanism 102. The bathing suit garment 100 is therefore designed such that only the front center of the lower portion of the garment 100 is exposed when the skirt panel 103 is down. As previously noted, the front panel 106 includes connectors 108, and the front panel 106 forms the front of the underwear portion of the bathing suit garment 100 when attached to the waistband panels 107 via the connectors 109 located on the outside of the waistband panels 107. When engaged, to the extent that the connectors 108 and 109 are visible from the outside of the front panel 106, the connectors 108 and 109 are completely covered by the skirt panel 103 when the skirt panel 103 is in the down position.

Figure 4:
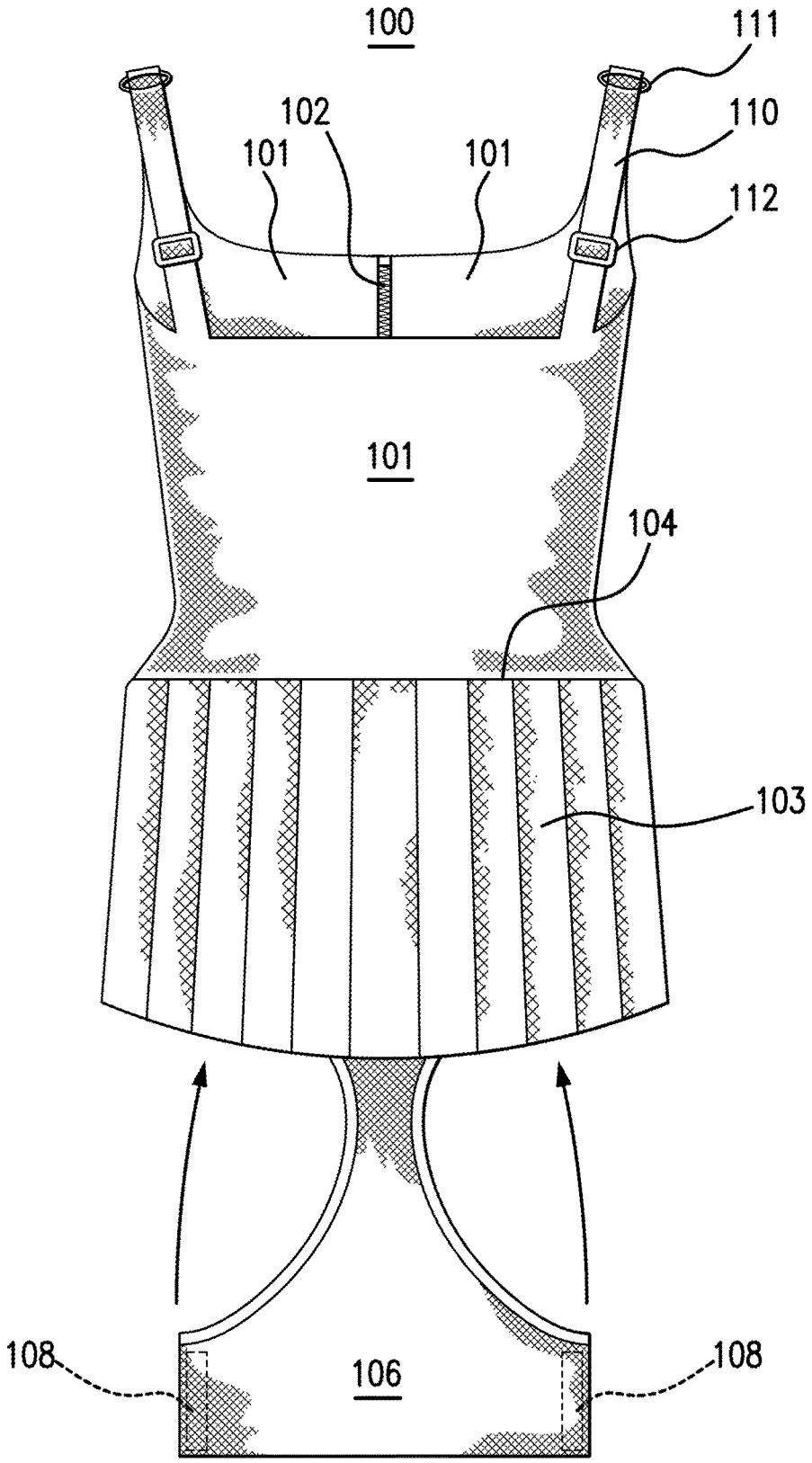
FIG. 4 illustrates a back view of an example women's one-piece bathing suit garment according to an embodiment of the present invention wherein the front panel is disengaged.

FIG. 4 illustrates a back view of an example women's one-piece bathing suit garment 100 according to an embodiment of the present invention, wherein the front panel 106 of the underwear portion of the garment 100 is open. In FIG. 4, the skirt panel 103 is attached to the vest-like bodice panel 101 via the connection mechanism 104. The connection mechanism 104 creates a horizontal attachment between the bodice panel 101 and the skirt panel 103 which extends around the back of the vest-like bodice panel 101 of the garment 100. When down, the skirt panel 103 completely covers the primary panel 105.

In FIG. 4, the outside of the front panel 106 is illustrated. The front panel 106 includes the connectors 108 placed on the inside of the front panel 106, which are not shown in FIG. 4. The garment 100 is designed such that the front panel 106 is pulled through the legs of the user to the front of the body to close the underwear portion of the bathing suit garment 100. As previously noted, the front panel 106 is designed to attach to the waistband panels 107 by attaching the connectors 108 located on the front panel 106 to the connectors 109 located on the waistband panels 107. According to an embodiment, the bathing suit garment 100 is designed such that the connectors 109 are placed on the outside of the waistband panels 107 and attach to the connectors 108 which, as previously noted, are placed on the inside of the front panel 106. By connecting the front panel 106 to the waistband panels 107, the front panel 106 forms the front of the underwear portion of the garment 100.

Figure 5:
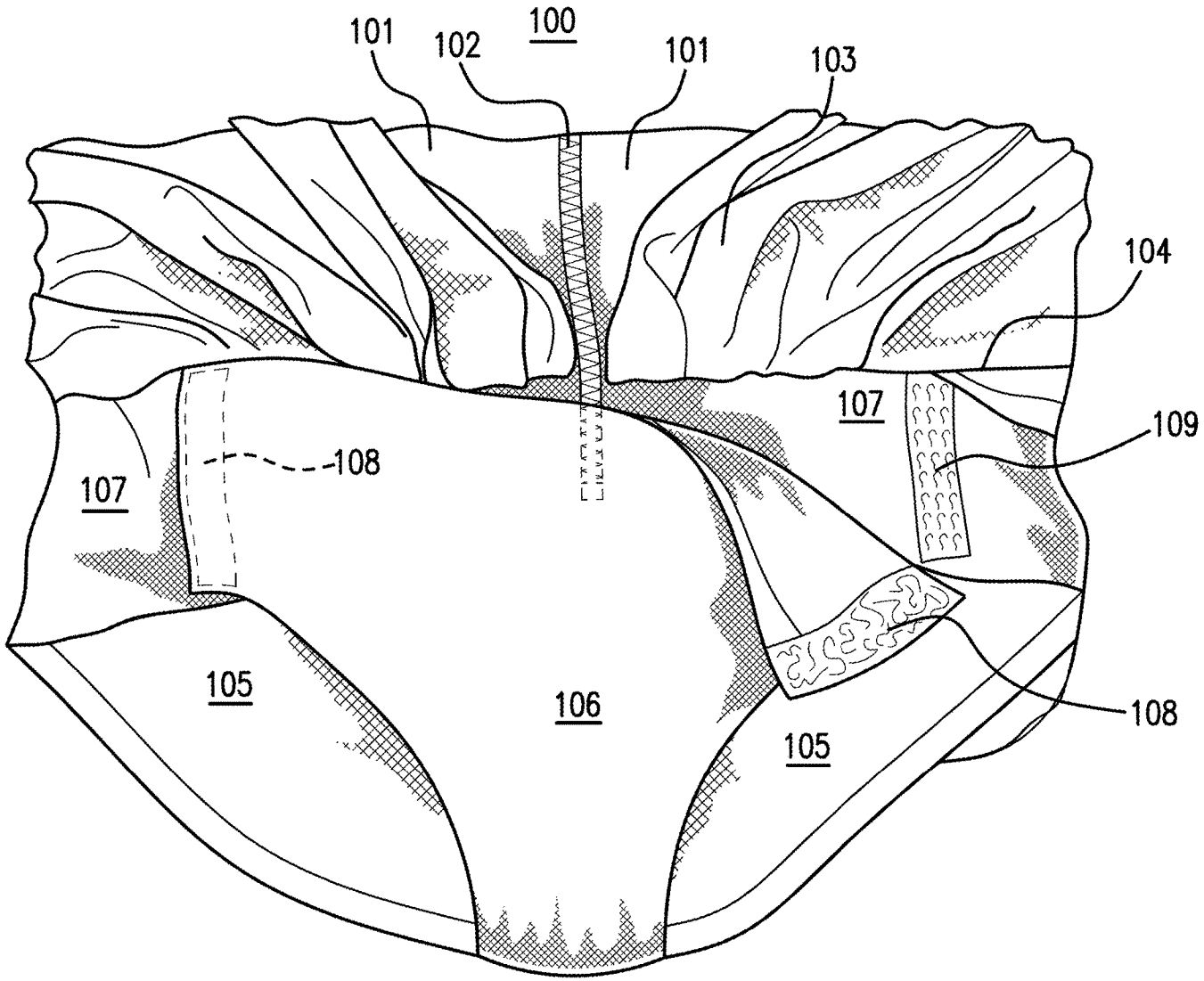
FIG. 5 illustrates a front view of the underwear portion of an example women's one-piece bathing suit garment according to an embodiment of the present invention wherein the front panel is partially engaged.

FIG. 5 illustrates a front view of the outside of the underwear portion of an example womens one-piece bathing suit garment 100 according to an embodiment of the present invention wherein the front panel 106 is partially engaged. As shown in FIG. 5, the front of the vest-like bodice panel 101 extends below the connection mechanism 104 to form the waistband panels 107. The skirt panel 103 is raised to illustrate the connectors of the front panel 106 and the waistband panels 107. As shown, the front of the waistband panels 107 includes the connectors 109 to attach to the front panel 106 via the connectors 108 placed on the inside of the front panel 106. The connectors 108 and 109 can each consist of a hook-and-loop fastener strip or other attaching mechanisms. The front panel 106 can alternatively be connected to the waistband panels 107 via one or more snaps, hooks, or other connecting mechanisms. The connection between the connector 108 on the front panel 106 and the connector 109 on the waistband panels 107 can be hidden by decorative elements or otherwise camouflaged in order to the make the bathing suit garment 100 more closely resemble a traditional one-piece bathing suit garment. For example, the skirt panel 103 is designed to completely cover the connectors 108 and 109 of the front panel 106 and the waistband panels 107, respectively, when the skirt panel 103 is left hanging down and in place during the use of the one-piece bathing suit garment 100 therefore hiding the connecting mechanisms 108 and 109.

As shown in FIG. 5, the connection mechanism 102 placed vertically down the front center of the bodice panel 101 is designed to extend downwards through the waistband panels 107. The connection mechanism 102 ends at the bottom of the waistband panels 107. By connecting the front panel 106 to the waistband panels 107, the front panel 106 overlaps both the waistband panels 107 and the bottom of the connection mechanism 102.

Figure 6:
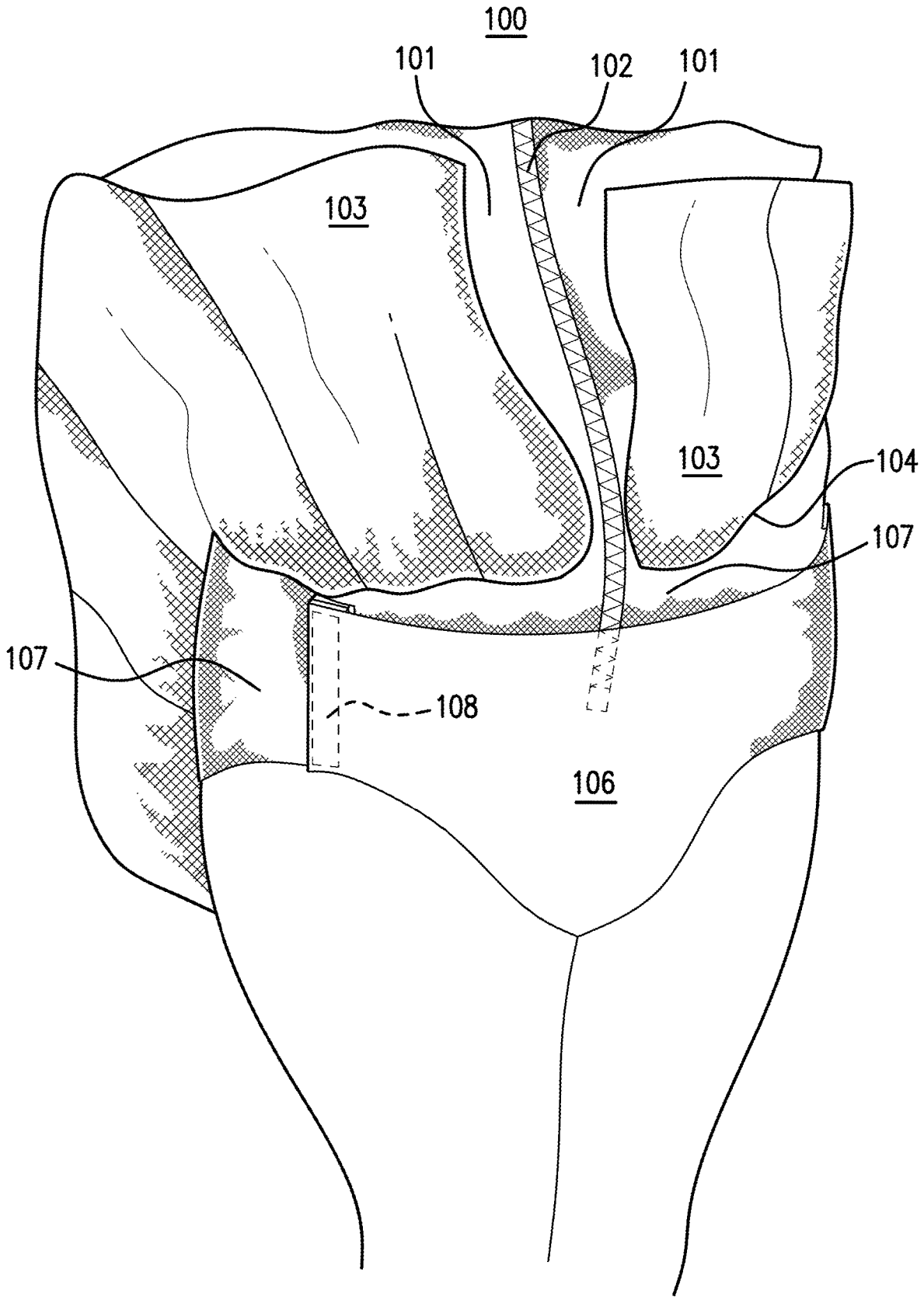
FIG. 6 illustrates a partial side view of the underwear portion of an example women's one-piece bathing suit garment according to an embodiment of the present invention wherein the front panel is fully engaged.

FIG. 6 illustrates a partial side view of the outside of the underwear portion of an example womens one-piece bathing suit garment 100 according to an embodiment of the present invention wherein the front panel 106 is fully engaged. FIG. 6 illustrates a potential attachment between the front panel 106 and the waistband panels 107, for example, via a hook-and-loop fastener strip 108 on the inside of the front panel 106 and a corresponding hook-and-loop fastener strip 109 on the outside of the waistband panels 107. According to an embodiment, it may be preferable to avoid metal clasps and closing mechanisms for the underwear portion of the garment 100 to provide greater comfort to all wearers, but especially for individuals who are bedridden or wheel-chair bound. As shown in FIG. 6, the primary panel 105 connects to the waistband panels 107 on the left and right sides via continuous pieces of material to form the leg openings. The front panel 106 forms the front of the underwear portion of the one-piece bathing suit garment 100 when fully engaged with the waistband panels 107, as illustrated by FIG. 6, however, the style and cut of the underwear portion of the bathing suit garment 100 can vary. For example, the front panel 106 can be shaped to have a higher cut, such that the side edges of the front panel 106 are shorter than the illustrated length.

As shown in FIG. 6, the front panel 106 overlaps the waistband panels 107 and the bottom of the connection mechanism 102 such that the waistband panels 107 and the end of the connection mechanism 102 are completely hidden by the front panel 106 when the front panel 106 is fully engaged.

Figure 7:
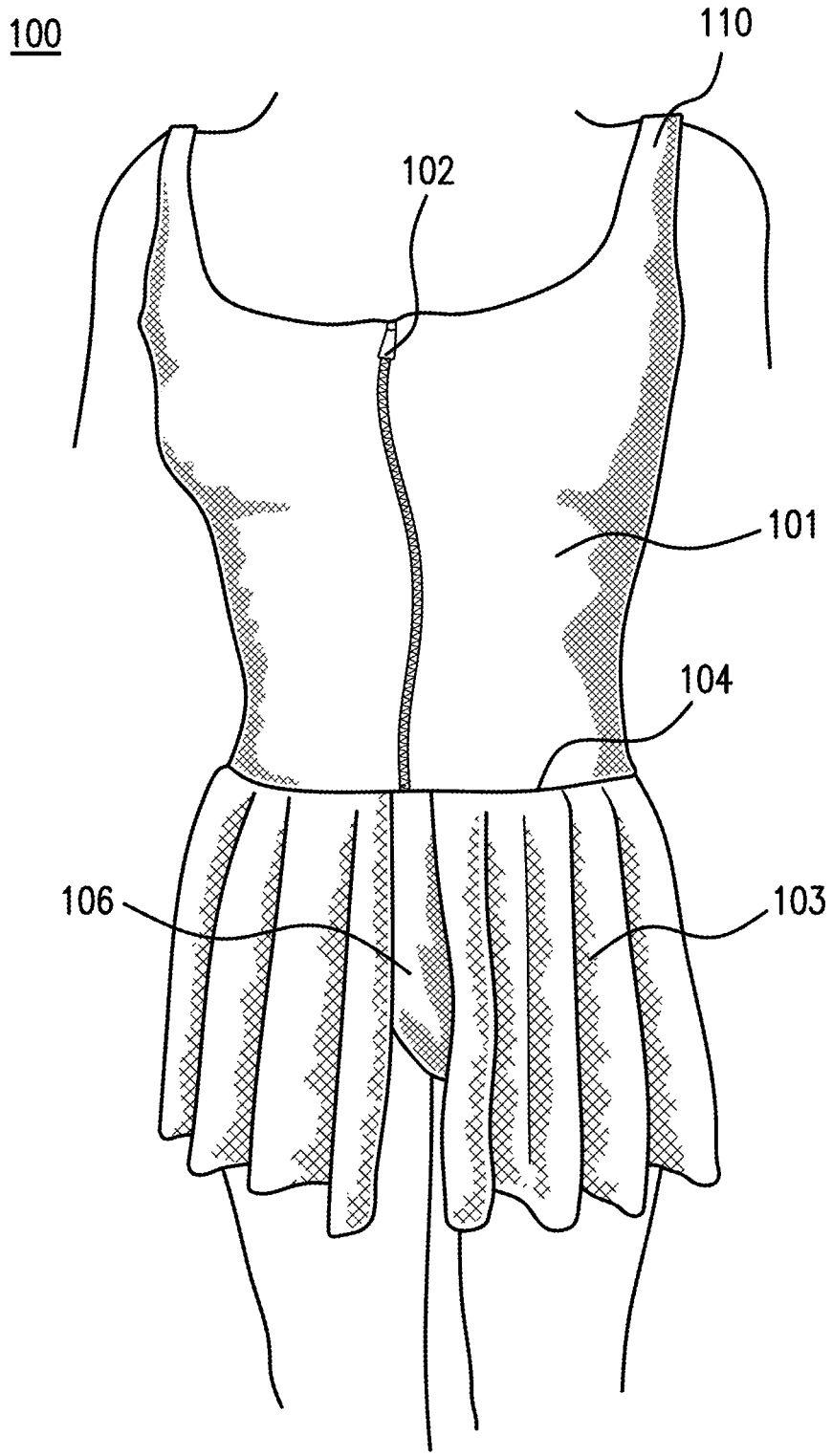
FIG. 7 illustrates a completely closed front view of an example women's one-piece bathing suit garment according to an embodiment of the present invention.

FIG. 7 illustrates a completely closed front view of an example women's one-piece bathing suit garment 100 according to an embodiment of the present invention. As shown, the bathing suit garment 100 can be designed such that the waistband panels 107 and the bottom of the connection mechanism 102 are completely covered by the front panel 106 when the front panel 106 is closed. When hanging down during normal use of the garment 100 by the wearer, the skirt panel 103 hides the connecting elements of the front panel 106 and the waistband panels 107 in order to make the one-piece bathing suit garment 100 more closely resemble a traditional bathing suit garment 100.

Figure 8:
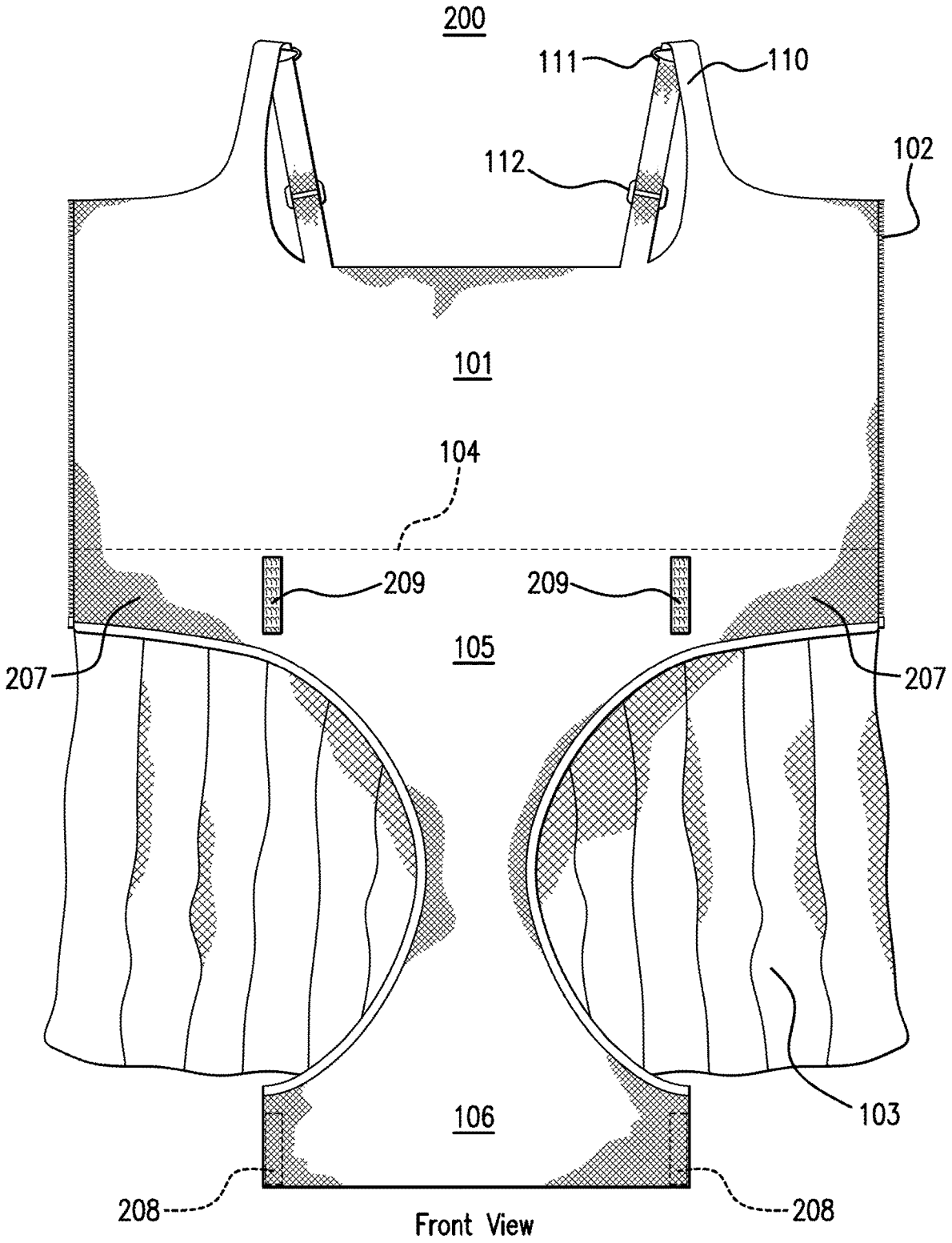
FIG. 8 illustrates a completely open front view of an inside of an example women's one-piece bathing suit garment according to an embodiment of the present invention.

FIG. 8 illustrates a completely open view of an inside of an example womens one-piece bathing suit garment 200 according to an embodiment of the present invention. The one-piece bathing suit garment 200 is similar to the one-piece bathing suit garment 100 in many respects. However, unlike the one-piece bathing suit garment 100, as shown in FIG. 8, the front panel 206 includes a pair connectors 208 on the outside of the front panel 206 (i.e., outside of the bathing suit 200). The connectors 208 can consist of hook-and-loop fastener attached to the outside of the front panel 206. As shown, each waistband panel 207 includes a connector 209, which is placed on the inside of each waistband panel 207 (i.e., inside of the bathing suit 200). The connectors 209 can consist of hook-and-loop fastener attached to the inside of the waistband panels 207. Each connector 208 of the front panel 206 can attach to the respective connector 209 of the respective waistband panel 207. When closed, the front panel 206 attaches to the waistband panels 207 to form the front of the underwear portion of the one-piece bathing suit garment 200

Figure 9:
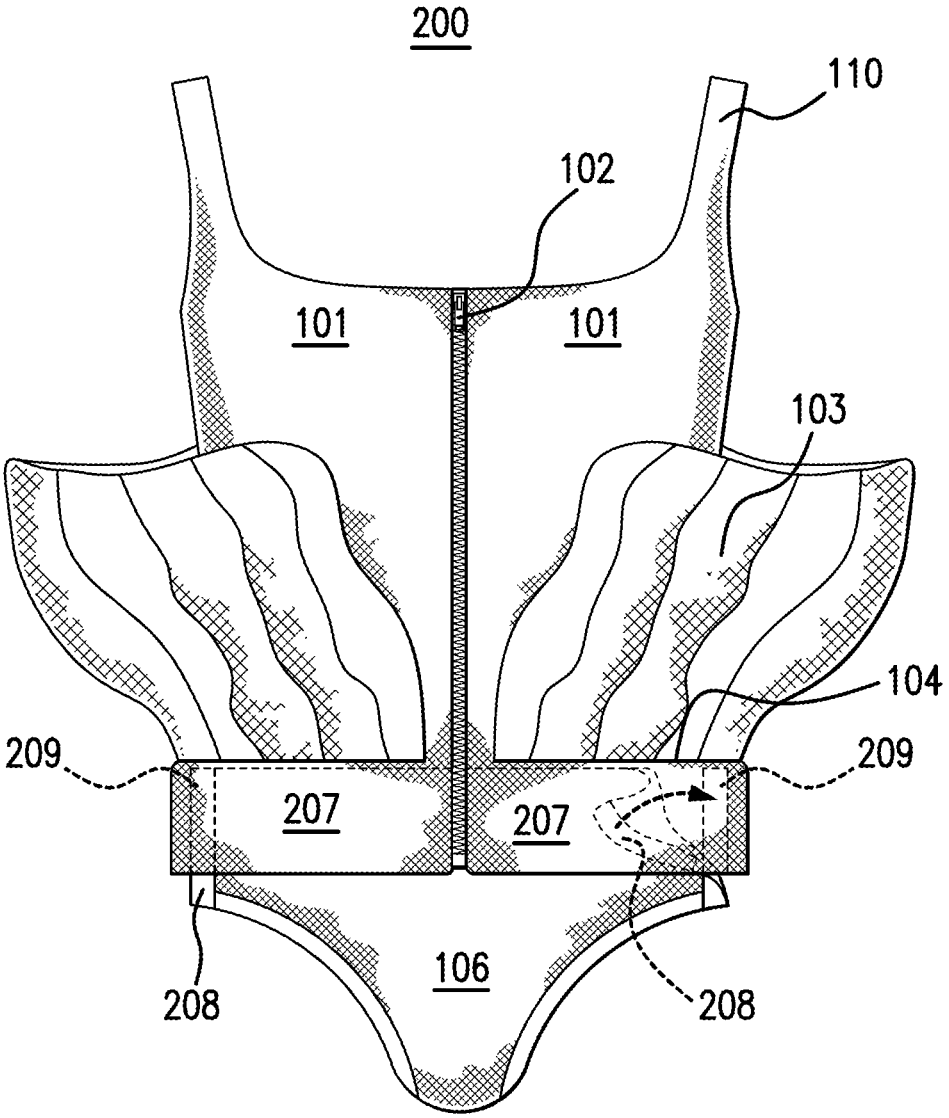
FIG. 9 illustrates a front view of an example women's one-piece bathing suit garment according to an embodiment of the present invention wherein the front panel is partially engaged.

FIG. 9 illustrates a front view of an example women's one-piece bathing suit garment 200 according to an embodiment of the present invention wherein the front panel 206 is partially engaged. As shown in FIG. 9, the skirt panel 103 is raised to expose the underwear portion of the bathing suit garment 200. As shown in FIG. 9, the front panel 206 includes a pair of connectors 208 attached to the outside of the front panel 206. Similarly, each waistband panel 207 includes a connector 209 attached to the inside of the respective waistband panel 207. In FIG. 9, the front panel 206 is partially engaged, i.e., one of the connectors 208 is connected to the respective connector 209. According to an embodiment, it may be preferable to avoid metal clasps and closing mechanisms for the underwear portion of the bathing suit garment 200 to provide greater comfort to all wearers.

The connection between the connectors 208 on the outside of the panel 206 and the connectors 209 on the inside of waistband panels 207 may not be visible to an observer as connectors 208 and 209 engage each other on the inside of the waistband panels 207. Nonetheless, decorative elements can be added to the garment 200 to more closely resemble a traditional one-piece bathing suit garment. For example, the skirt panel 103 is a non-exhaustive example of such decorative elements.

According to an embodiment, by connecting the front panel 206 to the waistband panels 207, the waistband panels 207 overlap the front panel 206, as illustrated by FIG. 9. As shown, the waistband panels 207 and the end of the connection mechanism 102 are exposed when the front panel 206 is closed.

Figure 10:
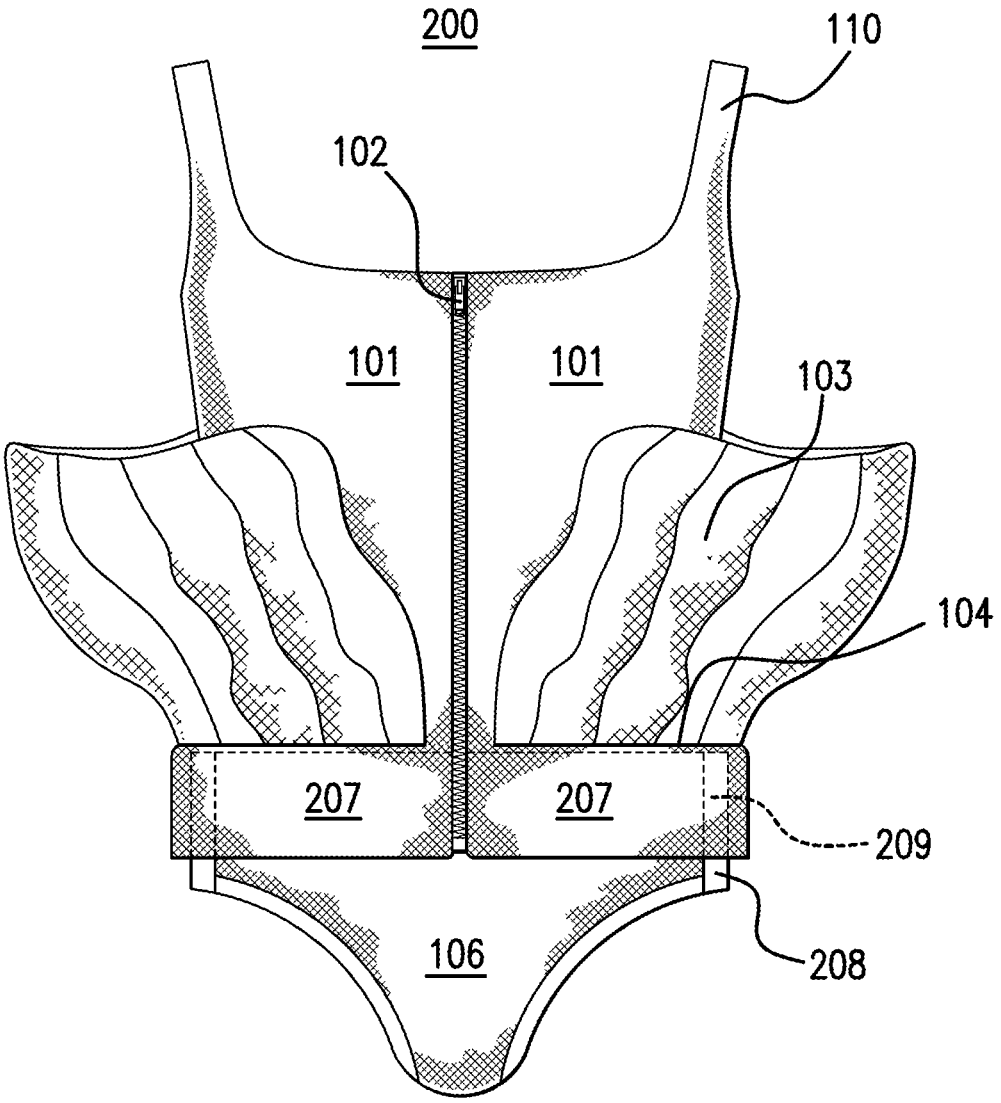
FIG. 10 illustrates a completely closed front view of an example women's one-piece bathing suit garment according to an embodiment of the present invention.

FIG. 10 illustrates a completely closed front view of an example women's one-piece bathing suit garment 200 according to an embodiment of the present invention. As shown in FIG. 10, the front panel 206 forms the front of the underwear portion of the one-piece bathing suit garment 200 when fully engaged with the waistband panels 207, however, the style and cut of the underwear portion of the garment 200 can vary. For example, the front panel 206 can be shaped to have a higher cut, such that the side edges of the front panel 206 are shorter than the illustrated length. As previously noted, the waistband panels 207 overlap the front panel 206 when the front panel 206 is fully engaged.

Figure 11:
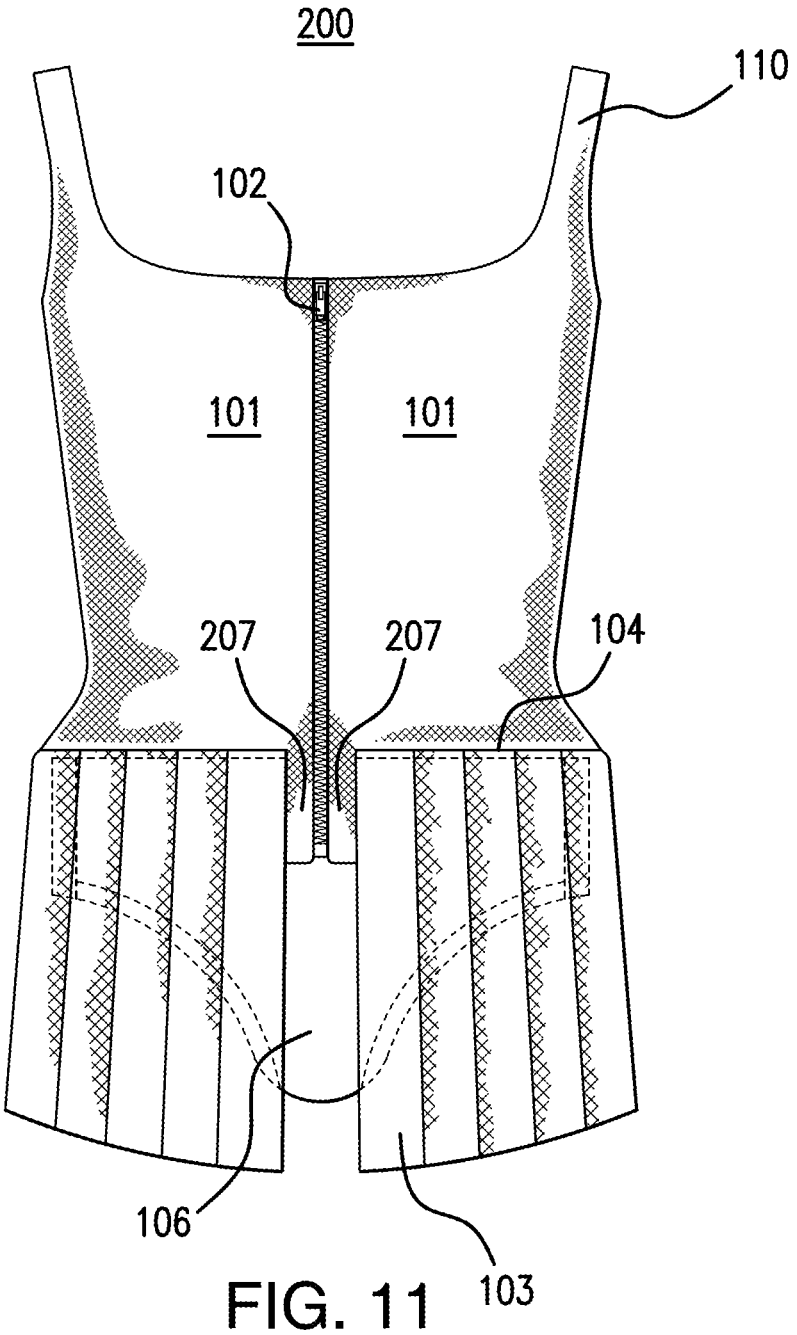
FIG. 11 illustrates a completely closed front view of an example women's one-piece bathing suit garment according to an embodiment of the present invention.

FIG. 11 illustrates a completely closed front view of an example women's one-piece bathing suit garment 200 according to an embodiment of the present invention. As shown, the skirt panel 103 and the connection mechanism 104 do not overlap the connection mechanism 102 therefore leaving the front center of the waistband panels 207 and the front panel 206 exposed when the garment 200 is completely closed. To the extent that the connectors 208 and 209 are visible, connectors 208 and 209 are completely hidden by the skirt panel 103 therefore making the garment 200 more closely resemble a traditional one-piece bathing suit garment.

The women's one-piece bathing suit garment can be designed with any of a variety of fabrics and types of materials, in different colors and prints. Any of the described embodiments can be manufactured with any known material, including for example elastic, cotton, or polyester.

According to one aspect of an embodiment, the bathing suit garments described herein can be manufactured with a spandex or otherwise stretchy elastic material, creating a compression garment that provides a slimming effect, and is easy to put on in the style of the embodiments described herein. Then if any or all of the vest-like bodice panel, primary panel, waistband panels, and front panel of the one-piece bathing suit garment are made of an elastic material, when the connection mechanisms are fully fastened, the bathing suit garment can have a slimming effect on the wearer. Any of the described embodiments can be manufactured with a spandex material as described to create a compression garment.

According to one aspect of an embodiment, the bathing suit garment can have multiple fasteners or connection mechanisms to connect the bodice panel and/or connect the front panel to the waistband panels. Then the wearer can connect the panels using one of the multiple connectors, each connector creating a different torso, shoulder, waist, or leg size, and the adjustable one-piece bathing suit garment can be resized as appropriate. Any of the described embodiments can have multiple fasteners or connection mechanisms creating an adjustable garment. For example, an elastic, compression version of any of the described designs can have multiple different fasteners to connect the panels, creating an adjustable garment. Other materials can also be used in an adjustable one-piece bathing suit garment, for example, cotton, polyester, or other material. According to an embodiment, an adjustable one-piece bathing suit garment can be designed to be one size to "fit all".

Although multiple different connection mechanisms are described herein, it will be understood that any known connector or fastener can be used.

FIGS. 1 through 11 illustrate example embodiments of the one-piece bathing suit garment. However, additional designs are contemplated. For example, a one-shoulder strap version can be created wherein a single shoulder strap can begin at the front of either the left or right side of the body and continue over either the left or right shoulder and attach at the back portion of the bodice panel to create a one-shoulder bathing suit. Additionally, a strapless version can be created wherein there are no shoulder straps provided, therefore creating a strapless or bandeau style bathing suit. Any of the provided styles can be adjusted in terms of torso cut, hip cut, position of the waist, length of a shoulder component, etc. Other implementations can also be used.

While the invention has been described in detail above with reference to some embodiments, variations within the scope and spirit of the invention will be apparent to those of ordinary skill in the art. Thus, the invention should be considered as limited only by the scope of the appended claims.

I claim:

1. A swimsuit, comprising:

a bodice panel being adapted for covering a torso of a human body, the bodice panel having a front top end;

the bodice panel including an underwear section, the underwear section being adapted for covering a bottom torso of the human body to form two leg openings, a crotch section disposed between the two leg openings, a pull-through section extending from the crotch section, and a rear section extending from the crotch section and the rear section defining a waistband section being adapted to be disposed at a waist of the human body, and the waistband section having a front bottom end adapted to extend below the waist of the human body, the pull-through section having a left free edge connected to a top free edge, and the top free edge being connected to a right free edge, the left free edge and the right free edge being laterally disposed to each other;

the bodice panel and the underwear section each having corresponding left ends and corresponding right ends being adapted to be joined together with a linear directional connector having interlocking extensions, the linear directional connector being vertically disposed on a front center of the bodice panel and a front center of the waistband section of the underwear section during in-use engagement of the linear directional connector, the linear directional connector extending between the front top end of the bodice panel and the front bottom end of the waistband section of the underwear section;

a plurality of mechanical connectors being collectively and laterally disposed on the pull-through section and on the waistband section so that a top front portion of the pull-through section of the underwear section is adapted to be detachably joined underneath the waistband section of the underwear section; and a skirt panel having a top end and an opposing bottom end, the top end having a top left end and a top right end, the top end of the skirt panel being attached to the waistband section, the top end of the skirt panel extending between the top left end and the top right end, wherein the top left end of the skirt panel terminates at a left predetermined horizontal distance relative to the vertical front center of the waistband section including the linear directional connector, and the top right end of the skirt panel terminates at a right predetermined horizontal distance relative to the front center of the waistband section including the linear directional connector, wherein the right predetermined horizontal distance and the left predetermined horizontal distance collectively define an open vertical gap arrangement being free of the skirt panel on a front side of the waistband section between the top left end and the top right end of the skirt panel while the skirt panel extends around the waistband section between the top left end and the top right end of the skirt panel.

2. The swimsuit according to claim 1, wherein the linear directional connector further comprises a zipper.

3. The swimsuit according to claim 1, wherein the plurality of mechanical connectors further comprises hook and loop fasteners.

4. The swimsuit according to claim 3, further comprising a plurality of shoulder straps being laterally disposed and adapted to engage shoulders of the human body, the plurality of shoulder straps being connected to the bodice panel, each of the shoulder straps having a first adjustable strap portion with a first connector and a second adjustable strap portion with a second connector to enable each shoulder strap to have an adjustable length.

5. The swimsuit according to claim 1, comprising a plurality of shoulder straps being adapted to engage shoulders of the human body, each of the shoulder straps having opposing distal ends, the distal ends of the plurality of shoulder straps being connected to the bodice panel, each of the shoulder straps having a first adjustable strap portion with a first connector and a second adjustable strap portion with a second connector to enable each shoulder strap to have an adjustable length.

6. The swimsuit according to claim 1, further comprising the skirt panel being detachably connected to the bodice panel at the top end of the skirt panel, the skirt panel having a first connector extending between the top left end and the top right end of the skirt panel, and a complementary first connector being horizontally disposed on the waistband section.

7. The swimsuit according to claim 1, wherein the interlocking extensions of the linear directional connector further comprise teeth.

8. The swimsuit according to claim 1, wherein the top free edge of the pull-through section is disposed above the front bottom end of the waistband section during in-use connected engagement of the plurality of mechanical connectors on the pull-through section and the waistband section of the underwear section.

9. The swimsuit according to claim 1, wherein the top free edge of the pull-through section is disposed above the front bottom end of the waistband section during in-use connected engagement of the plurality of mechanical connectors of the pull-through section and the waistband section of the underwear section, such that a portion of the pull-through section is revealed between the top left end of the skirt panel and the top right end of the skirt panel in the open vertical gap arrangement, and a vertical portion of the linear directional connector is concealed above a bottom end of the linear directional connector.

10. The swimsuit according to claim 1, wherein a bottom end of the linear directional connector, the bottom end of a left side of the waistband section, and the bottom end of a right side of the waistband section are revealed for in-use operation prior to connected engagement of the pull-through section to the waistband section, and the left predetermined horizontal distance and the right predetermined horizontal distance being less than a circumference of the bodice panel.

11. A swimsuit, comprising:

a bodice panel being adapted for covering a torso of a wearer, the bodice panel having a front top free edge, the bodice panel being connected to a waistband section being adapted to be disposed on a waist of the wearer, and the waistband section having a front bottom free edge adapted to extend below the waist of the wearer;

the bodice panel including an underwear section being adapted for covering a bottom torso of the wearer to form laterally disposed leg openings, a crotch section disposed between the leg openings, a pull-through section extending from the crotch section, a primary section extending from the crotch section to a rear of the bodice panel and the primary section being adapted to form the waistband section;

the bodice panel having a bodice left end and a bodice right end, the underwear section at the waistband section having a waistband left end and a waistband right end, the bodice left end and the waistband left end being aligned together to collectively form a continuous left end extending from the front top free edge of the bodice panel to the front bottom free edge of the waistband section, the bodice right end and the waistband right end being aligned together to collectively form a continuous right end extending from the front top free edge of the bodice panel to the front bottom free edge of the waistband section, the continuous right end and the continuous left end being adapted to be joined together with a linear directional connector having interlocking extensions, the linear directional connector being vertically disposed on a front center of the bodice panel and a front center of the waistband section during in-use engagement of the linear directional connector;

a plurality of connectors being collectively and laterally disposed on the pull-through section and on the waistband section so that a top front portion of the pull-through section of the underwear section is adapted to be detachably joined underneath the waistband section of the bodice panel; and a skirt panel having a top edge and a bottom edge, the top edge having a top left end and a top right end, the top edge of the skirt panel being attached to the waistband section, the top edge of the skirt panel extending between the top left end and the top right end, wherein the top left end of the skirt panel terminates at a left predetermined horizontal distance measured from the vertical front center of the waistband section including the linear directional connector, and the top right end of the skirt panel terminates at a right predetermined horizontal distance measured from the front center of the waistband section including the linear directional connector, wherein the right predetermined horizontal distance and the left predetermined horizontal distance collectively define an open vertical gap arrangement being free of the skirt panel on a front side of the waistband section between the top right end and the top left end of the skirt panel, while the skirt panel extends around the waistband section between the top left end and the top right end of the skirt panel.

12. The swimsuit according to claim 11, wherein the linear directional connector further comprises a zipper.

13. The swimsuit according to claim 11, wherein the plurality of connectors further comprises hook and loop fasteners.

14. The swimsuit according to claim 13, further comprising a plurality of shoulder straps being laterally disposed and adapted to engage shoulders of the wearer, the plurality of shoulder straps being connected to the bodice panel, each of the shoulder straps having a first adjustable strap portion with a first connector and a second adjustable strap portion with a second connector to enable each shoulder strap to have an adjustable length.

15. The swimsuit according to claim 11, further comprising a plurality of shoulder straps being adapted to engage shoulders of the wearer, each of the shoulder straps having opposing distal ends, the distal ends of the plurality of shoulder straps being connected to the bodice panel, each of the shoulder straps having a first adjustable strap portion with a first connector and a second adjustable strap portion with a second connector to enable each shoulder strap to have an adjustable length.

16. The swimsuit according to claim 11, further comprising the skirt panel being detachably connected to the bodice panel, the skirt panel having a first connector extending between the top left end and the top right end of the skirt panel, and a complementary first connector being disposed horizontally on the waistband section.

17. The swimsuit according to claim 11, wherein the interlocking extensions of the linear directional connector further comprise teeth.

18. The swimsuit according to claim 11, wherein a bottom distal end of the linear directional connector, the bottom free edge of a left side of the waistband section, and the bottom edge of a right side of the waistband section are revealed for in-use operation prior to connected engagement of the pull-through section to the waistband section.

* * * * *